US006144750A

United States Patent [19]

Levin

[11] Patent Number: 6,144,750

[45] Date of Patent: Nov. 7, 2000

[54] HEARING AID DEVICE

[76] Inventor: Joanne Levin, 6604 Lakewood Point Cove, Austin, Tex. 78750

[21] Appl. No.: 09/008,207

[22] Filed: Jan. 16, 1998

Related U.S. Application Data

[60] Provisional application No. 60/036,082, Jan. 16, 1997.

[51] Int. Cl.[7] ..... H04R 25/00

[52] U.S. Cl. ..... 381/328; 381/322; 181/129

[58] Field of Search ..... 381/313, 315, 381/322, 328, 330; 181/129, 130, 135

[56] References Cited

U.S. PATENT DOCUMENTS

| | | | |
|---|---|---|---|
| 4,471,490 | 9/1984 | Bellafiore | 381/328 |
| 4,532,649 | 7/1985 | Bellafiore | 381/328 |
| 4,735,759 | 4/1988 | Bellafiore | 264/221 |
| 5,253,300 | 10/1993 | Knapp | 381/315 |

OTHER PUBLICATIONS

Brochure entitled: "I was reluctant to try hearing aids . . . until I tried these,", ©Starkey Labs Inc., BRO1132–0 (publication date unknown).

Brochure entitled: "A Hearing Aid As Easy on the Eyes as it is in the Ear," ©Starkey Labs Inc. (publication date unknown) BRO 1237–0.

Brochure entitled: "Shaping the Future of Better Hearing," ©Beltone Electronics Corporation, 1997.

Brochure entitled: "REXTON Manufactures for fine Hearing Instruments," PN590, 1996.

Brochure entitled: "People come in different shapes, sizes and colors . . . Shouldn't Hearing Instruments?" (publication date unknown).

Brochure entitled: "HORIZON technology worth hearing about," ©REXTON, PN827, Rev. 8 97.

Brochure entitled: "Hearing Healthy," RX–38 CIC REXTON.

Brochure entitled: "The Brilliance of Sound™, Advanced Technology Hearing Aids," SHI/01655–6, 1996.

Brochure entitled "Prisma™, Fully Digital Hearing Aids Consumer Information," SHI/02556–8, ©1998.

Brochure entitled "Music®, A Sound Experience," SHI/02773–8, ©1998.

Brochure entitled: microzoom™, The new standard in noise–reduction technology, PHONAK, CON213 US Jul. 1997.

Brochure entitled: "PHONAK Style Solutions," (publication date unknown).

Brochure entitled: "PHONAK PICS & E–PROM Programmable in–the–ear Solutions" (publication date unknown).

Paris Miki—Hearing Aid Dispenser Japanese Brochure, English translation attached (publication dated unknown).

Oticon Canal Model I–55 Japanese Brochure, English translation attached, (publication date unknown).

Panasonic Japanese Brochure, English translation attached (publication date unknown).

Brochure entitled: "DigiFocus: the digital breakthrough in hearing," by Oticon (publication date unknown).

Brochure entitled: "Listen to the sounds of life," by Magnatone: Quality hearing instruments, Casselberry, FL, 1996.

Brochure entitled: "AudioChoice™ Hearing Aids," by Miracle Ear® Hearing Systems by Bausch & Lomb, 1994.

Brochure entitled: Miracle–Ear® Hearing Aids by Miracle Ear® Hearing Systems by Bausch & Lomb, 1994.

Brochure entitled: "Montgomery Ward Brings You the Mirage® Hearing Aid;" by Miracle–Ear® Hearing Systems by Bausch & Lomb, 1996.

(List continued on next page.)

*Primary Examiner*—Curtis A. Kuntz
*Assistant Examiner*—Dionne N. Harvey
*Attorney, Agent, or Firm*—Fulbright & Jaworski

[57] ABSTRACT

Disclosed are hearing aid devices in which a face plate of said devices has variable shades of coloring to mimic the natural shading of the ear, and to make the hearing aid less visible to an observer when worn in the ear. Also disclosed are hearing aid devices in which visible battery compartment covers are shaped to mimic natural curves of the ear and to be less visible to an observer.

6 Claims, 4 Drawing Sheets

OTHER PUBLICATIONS

Brochure entitled: "Understand and participate. For your personal communications needs: technology developed by AT&T Bell Laboratories and ReSound® Corporation," by ReSound® Personal Hearing System, ReSound Corp., Redwood City, CA. (publication date unknown).

Brochure entitled: "Resound Good Things Really Do Come In Small Packages," by ReSound® Personal Hearing System, ReSound Corp., Redwood City, CA. (publication date unknown).

Brochure entitled: "SoftWear™ fits my lifestyle. Comfortably.," SoftWear™ premium soft–shell hearing instruments, Telex Communications, Inc., Minneapolis, MN. (publication date unknown).

Brochure entitled: "Hearing is our concern," by ©Starkey Laboratories, Inc. (publication date unknown).

HEARING AID DEVICE

This Appln claims the benefit of U.S. Provisional No. 60/036,082, filed Jan. 16, 1997.

BACKGROUND OF THE INVENTION

Hearing aid devices can generally be divided into three categories: those that are located behind the ear (behind-the-ear models), those that fit primarily within the concha of the external ear (in-the-ear models), and those that are located almost totally within the ear's auditory canal (in-the-canal models). Typically hearing aids are composed of standard module hearing aids integrated into otoplastics derived from individual patient molds. The housings/face plates of hearing aids have openings for battery compartments, most often with a round, oval, square or rectangular cover (see for example U.S. Pat. No. #5,257,315).

Often, people who suffer from hearing loss feel a stigma attached to wearing a hearing aid. In some cases, this perceived stigma can keep hearing-impaired persons from wearing the devices necessary to correct their hearing loss, leaving them cut off from effective communication with the rest of society.

Despite the many recent advances in making increasingly smaller hearing aid devices, further design advancements, particularly relating to the color and shape of the devices, may help to make in-the-ear hearing aids even more invisible to the casual observer. For example, the present inventor is aware of no hearing aid design to-date that has taken into account the gradual changes in coloration or shading necessary to truly mimic the human ear as it appears to observers. The external ear (FIG. 1), called the pinna or auricle 10 is ovoid in shape and contains several structural features including the concha 12, a deep capacious cavity that leads into the auditory canal 14. Because of the various thicknesses of the ear structures and the shading caused by eminences or projections over the concha region, the interior of the external ear appears to be increasingly darker as one's eye approaches the auditory canal. The auditory canal itself may appear almost black, even in a light-skinned person. Monochromatic hearing aids are often colored to resemble the outer or helix 16 and antihelix 18 portions of the auricle 10 and do not mimic this natural shading effect. These hearing aids are thus more noticeable and call an observer's attention to the presence of a hearing aid.

There is a need therefore, for a hearing aid device that offers less contrast in appearance to the ear itself, and therefore, less visibility. Such a hearing aid, of whatever design or material, would make the hearing aid device less noticeable, and thus less of a stigma or embarrassment to the wearer. Furthermore, there is a need for a hearing aid in which all housing doors, such as a battery compartment door resemble the ovoid curves and shapes of the ear structures, rather than round or angular geometrical shapes that do not often occur in natural body structures.

SUMMARY OF THE INVENTION

It is an object of the present invention to provide a hearing aid, and especially a hearing aid that sits totally within the concha and/or auditory canal of the wearer, such that the coloration of the hearing aid face plate is variably colored to match the natural shadings that occur in the external human ear. By this gradual, variable coloring, the hearing aid offers less contrast to the natural shadings of the ear than a monochromatic hearing aid and is thus less noticeable. It is an additional object to provide a hearing aid in which a visible battery compartment cover is irregularly ovoid to more closely resemble the natural curving lines of the external ear.

As used herein, the term "irregularly ovoid" means of an irregular shape, i.e. a shape containing no right, acute or obtuse angles, and that is not a circle nor an ellipse. Also as used herein the term "full shell" is defined as a hearing aid device that is large enough to cover essentially the entirety of the concha 12 of the ear of a wearer. It will be understood by those in the art that the coloring of the skin and hair will vary among individual wearers of hearing aid devices. Therefore, it is an embodiment of the present invention that face plates may be made available in a range of average colorings to be matched to a wide range of natural skin colorings of individual wearers, or the colorings may be applied to individual devices based on a digital or other visual image taken directly from an ear area of the wearer.

DESCRIPTION OF ILLUSTRATIVE EMBODIMENTS

Figure 1:
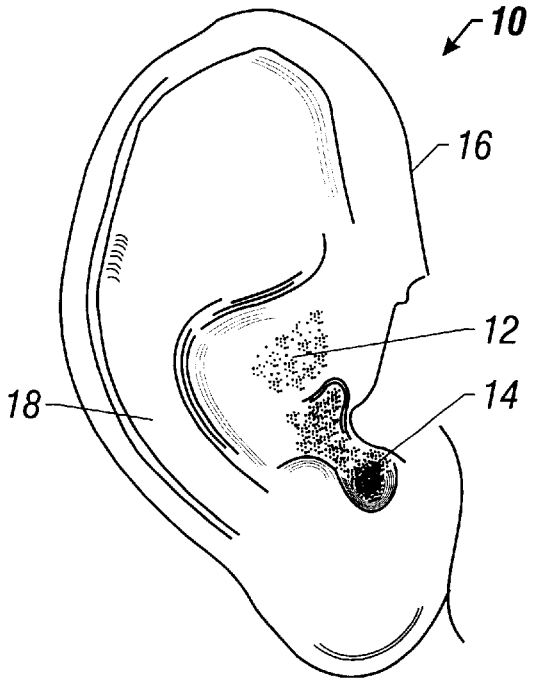
FIG. 1. External ear or auricle.
Figure 2:
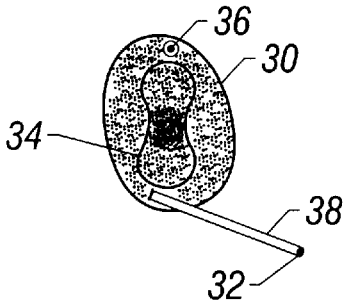
FIG. 2.
Figure 3:
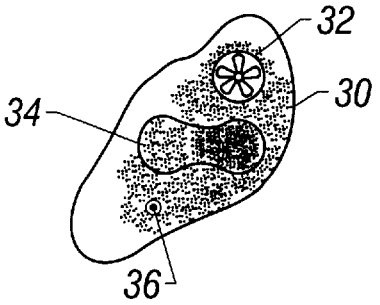
Figure 4:
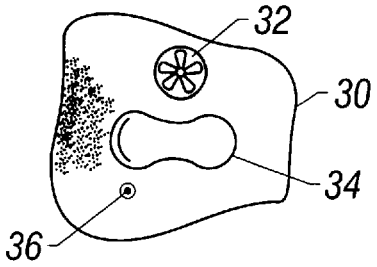
Figure 5:
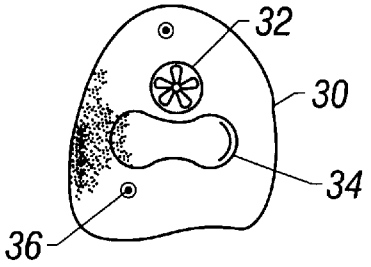
Figure 6:
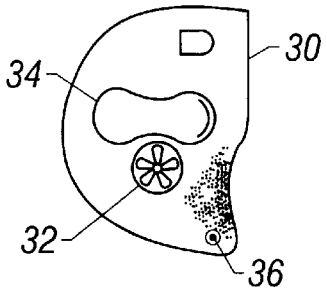
Figure 7:
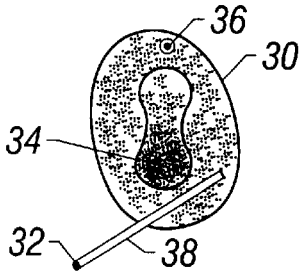
Figure 8:
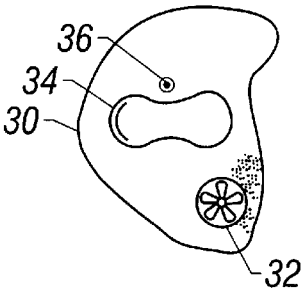
Figure 9:
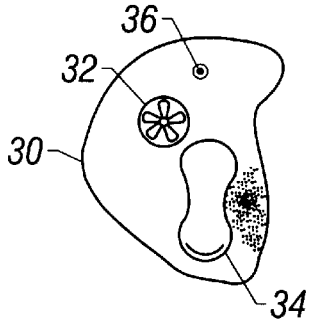
Figure 10:
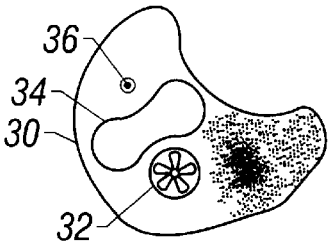
Figure 11:
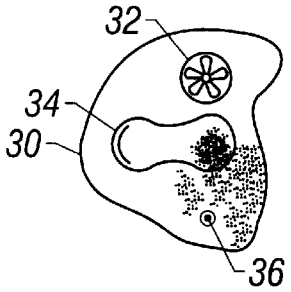
Figure 12:
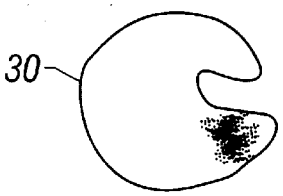
Figure 13:
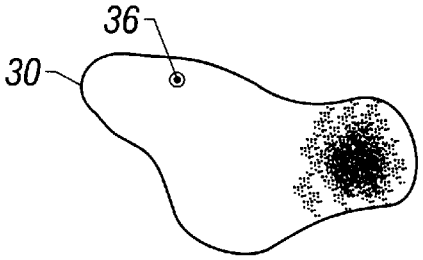
Figure 14:
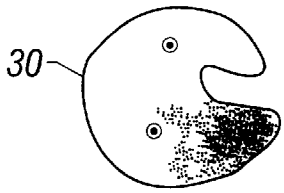
Figure 15:
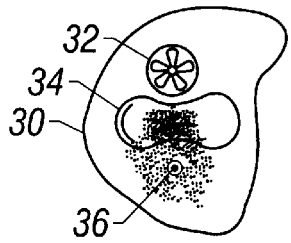
Figure 16:
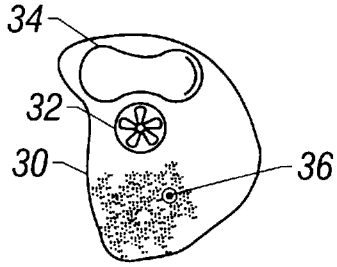
Figure 17:
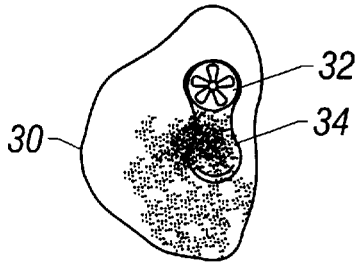
Figure 18:
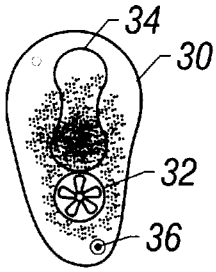
Figure 19:
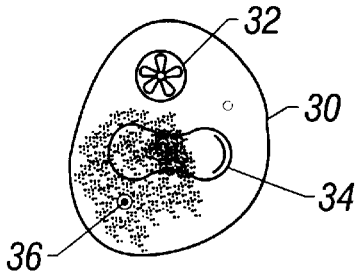
Figure 20:
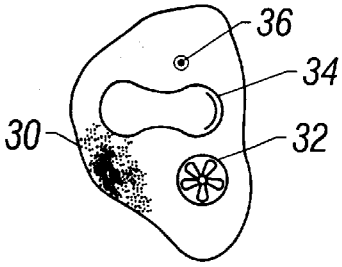
Figure 21:
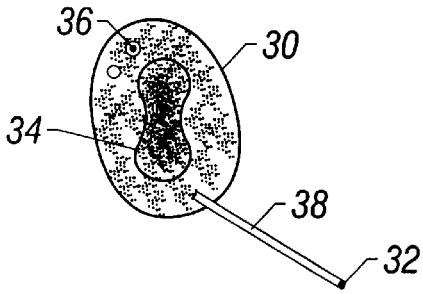
Figure 22:
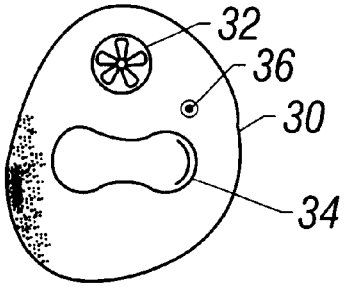
Figure 23:
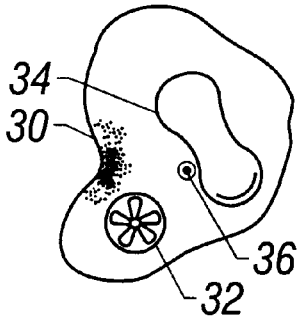
Figure 24:
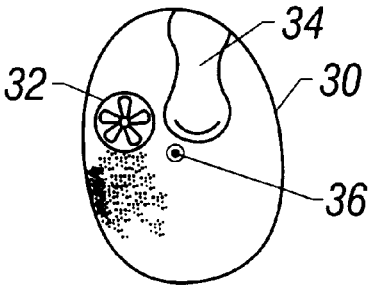
–FIG. 24. Top views of in-the-ear and auditory canal hearing aid devices of various shapes, sizes and styles looking down on face plate.

Turning to the drawings, in particular FIGS. 2–24, the drawings represent top views, (the surface an observer would see when the hearing aid is worn) of various in-the-ear, and in the ear canal hearing aids. This type of hearing aid typically includes a face plate (base plate) 30, upon which are a volume control 32, a battery compartment cover 34, and a microphone opening 36. The battery compartment cover 34 is typically hingably connected to the face plate 30 for easy access to the battery compartment beneath. The volume control 32 is typically of rotary design, although a digital volume control comprising a small lever or other adjusting means, or even a remote control device may also be used. Additionally, in certain hearing aid devices an extractor line 38 may also be used for removal of the hearing aid device and may contain a volume control. The microphone opening 36 is typically continuous with a microphone within the housing of the hearing aid.

Figure 25:
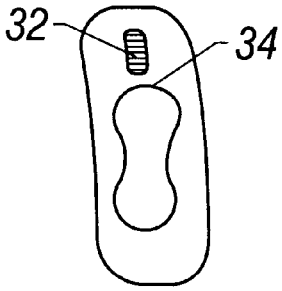
FIG. 25 Back view of behind the ear hearing aid.

The present invention provides an improvement over prior hearing aid devices, in that the gradual colorations of the in-the-ear, and in the ear canal hearing devices of the present invention are designed to imitate or copy the natural shadings of the ear. The shading, which typically gets darker as one approaches the auditory canal or on certain edges of the face plate in larger devices such as full shell devices, results in a camouflaging effect, thereby making the hearing aid device less obvious to an observer, and less of a stigma to the wearer. This object is achieved by making the hearing aid face plate, of whatever design or material, of variable coloration, so that the part of the face plate laying closest to the center of the ear appears lightest in coloring, resembling the skin color of the wearer. The part of the hearing aid device that lies farther inside the concha as it approaches the auditory canal, and in larger models, that part that is shaded by the helix 16 or anti-helix 18 portions of the auricle 10 is increasingly brownish-gray, while that part of the hearing aid device laying closest to, and entering into or covering the opening of the auditory canal 14 farthest away from the helix, may be progressively light to dark brown, light to dark gray, black, or a progressive mixture or gradation of these colors. It is a further aspect of the invention, that the battery compartment cover 34 is irregularly oblong or ovoid in shape, in particular without the presence of a right, acute or obtuse angle, in order to more closely resemble the natural curves of the ear. It is also understood that the natural curve effect of the battery compartment cover may project into three dimensions, or give the appearance of a third dimension by providing the appearance of either an indention, depression or a projection. This three dimensional aspect of the battery compartment cover design adds to the natural shading effect of the ear structures. This embodiment also applies to the battery compartment cover of a behind-the-ear hearing aid device, as shown in FIG. 25.

The present invention is envisioned to be useful for any hearing device, manufactured of any material and by any means known in the art. For example, the face plate, or bas( cover and/or housing of the hearing aid device may be manufactured of a plastic, latex, acrylic or polymeric material of any type known in the art. Exemplary manufacturing methods include, but are not be limited to otoplastic devices made in negative molds of the intended wearer's ear as described in U.S. Pat. Nos. 5,146,051 and 4,735,759, for example, or those made of dyeable injection/extrusion molding material, either mass produced or personally fitted. The colors may be applied by any method known in the art, either prior to polymerization or curing of the face plate material, or after the device is fully molded, including the application of a colored layer to the finished face plate followed by sealing of the applique.

Printing methods known in the art that may be used to apply the color to a hearing aid device include, but are not limited to grinding or etching a design into a hardened face plate and then applying inks, dyes, paints or other coloring agents to the prepared area. In addition, an area may be prepared for a cellulose patch bearing the desired coloration which is then applied to the prepared area. In both these embodiments, the colored area may be sealed, such as with a transparent polymer glue or coating. Other methods may include laser etching, photoengraving, hot stamping, acid etching, a photomasking technique analogous to that described in U.S. Pat. No. 5,153,084, or applique techniques in which an image is applied to the inner surface of a mold and then a plastic or polymer is injected into the mold, as described in U.S. Pat. Nos. 5,514,317, 5,512,226 or 5,264,172.

Hearing aid devices manufactured and colored by any of such methods known to those in the art would be encompassed by the scope and spirit of the claimed invention.

What is claimed is:

1. An in-the-ear hearing aid device, wherein the face plate of said device is variably colored such that the area covering the central region of the concha is similar to the flesh tone of a wearer and wherein the coloration is progressively darker proceeding to the area covering the entrance to the auditory canal, wherein the area covering the entrance to the auditory canal is light to medium brown, dark brown, gray, light to dark gray, or black, to mimic the shadings of the ear concha and entrance to the auditory canal of said wearer.

2. The hearing aid device of claim 1, further comprising a visible battery compartment cover, wherein said cover is of an irregular ovoid or oblong shape to visually blend with the naturally occurring curves of the ear.

3. A hearing aid device of claim 1, further defined as a full shell device and wherein the face plate of said device is shaded on the outer edge to mimic the shading of the helix and antihelix of the outer ear.

4. The hearing aid device of claim 1, further comprising a visible battery compartment cover, said cover comprising, an indentation, a depression, or a projection.

5. An in the ear canal hearing aid device wherein the face plate of said device has variable shading colorations proceeding from a flesh tone to light to medium brown, dark brown, light gray to dark gray, or black, to mimic the inward depth of the ear canal.

6. An in the ear hearing aid device wherein the face plate of said device comprises progressively darker shading approaching the auditory canal to mimic the inward depth of the ear canal.

* * * * *